US009409194B2

(12) United States Patent
Alluigi

(10) Patent No.: US 9,409,194 B2
(45) Date of Patent: Aug. 9, 2016

(54) DISPENSING DEVICE FOR A LIQUID WITH MULTIFUNCTION NOZZLE

(75) Inventor: Riccardo Alluigi, Alessandria (IT)

(73) Assignee: Guala Dispensing S.p.A., Alessandria (IT)

( * ) Notice: Subject to any disclaimer, the term of this patent is extended or adjusted under 35 U.S.C. 154(b) by 732 days.

(21) Appl. No.: 13/640,572

(22) PCT Filed: Jun. 9, 2010

(86) PCT No.: PCT/IT2010/000257
§ 371 (c)(1),
(2), (4) Date: Feb. 4, 2013

(87) PCT Pub. No.: WO2011/154979
PCT Pub. Date: Dec. 15, 2011

(65) Prior Publication Data

US 2013/0119157 A1 May 16, 2013

(51) Int. Cl.

| | |
|---|---|
| ***B05B 7/30*** | (2006.01) |
| ***B05B 11/00*** | (2006.01) |
| ***B05B 1/16*** | (2006.01) |
| ***B05B 1/30*** | (2006.01) |

(52) U.S. Cl.
CPC ..... *B05B 7/30* (2013.01); *B05B 1/1654* (2013.01); *B05B 1/3026* (2013.01); *B05B 11/3057* (2013.01); *B05B 11/3011* (2013.01)

(58) Field of Classification Search
CPC ..... B05B 1/1654; B05B 11/3057
USPC ..... 239/333, 390, 391, 392, 394, 397; 222/548, 554, 557, 563
See application file for complete search history.

(56) References Cited

U.S. PATENT DOCUMENTS

| | | | | |
|---|---|---|---|---|
| 4,350,298 | A * | 9/1982 | Tada | B05B 7/005 222/380 |
| 5,228,600 | A * | 7/1993 | Steijns | B05B 1/12 222/153.01 |
| 5,878,959 | A * | 3/1999 | Smolen, Jr. | B05B 1/042 239/121 |
| 6,536,686 | B2 | 3/2003 | Dukes et al. | |
| 8,714,415 | B2 * | 5/2014 | Rech | B05B 11/0059 222/376 |
| 2007/0131718 | A1 * | 6/2007 | Bistolfi | B05B 11/0016 222/189.09 |

FOREIGN PATENT DOCUMENTS

| | | | |
|---|---|---|---|
| JP | 62011566 | A | 1/1987 |
| JP | 2007319771 | A | 12/2007 |

OTHER PUBLICATIONS

International Search Report in corresponding International Patent Application No. PCT/IT2010/000257, dated Mar. 30, 2011 (3 pages).

* cited by examiner

*Primary Examiner* — Len Tran
*Assistant Examiner* — Alexander Valvis
(74) *Attorney, Agent, or Firm* — Kilyk & Bowersox, P.L.L.C.

(57) ABSTRACT

A trigger-operated dispensing device for a liquid comprising a tang (12) applied to the exit duct, a nozzle (30) applied to a tang, an insert (60) applied to the nozzle (30), axially bound and rotatable around the dispensing axis (X), provided with two openings (62, 64) for dispensing the liquid as a spray or as a foam. The insert (60) comprises an obturator (68), shaped to close/open the device.

16 Claims, 7 Drawing Sheets

DISPENSING DEVICE FOR A LIQUID WITH MULTIFUNCTION NOZZLE

This application is a National Stage Application of PCT/IT2010/000257, filed Jun. 09, 2010.

The present invention relates to a dispensing device for a liquid, manually operated, for example by a trigger. In particular, the present invention relates to a trigger dispensing device able to dispense the liquid in at least two forms of the dispensed jet. Such type of dispensing device is known in the sector as a "multifunction" dispensing device.

In the dispensing devices sector and in particular in that of the devices destined for domestic use, the need to spray liquid with multiples types of jet is strongly felt, for example so as to obtain an almost continuous jet in a clearly specified direction, or a more nebulised jet distributed in space. The two jets are generally dispensed from different openings on the nozzle.

Many solutions of multifunction dispenser devices exist. Some of these are illustrated for example in documents U.S. Pat. Nos. 6,997,397, 6,536,686, 6,446,882, 6,382,527, 5,664,732, IT 1311301.

In particular, one solution is illustrated in the patent application BS2010A000003 in the name of the Applicant.

The purpose of the present invention is to further improve the functionality of the existing solutions, making them simpler to use by the final user, further simplifying the structure of the device.

Such purpose is achieved by a dispensing device made according to claim 1.

Figure 1:
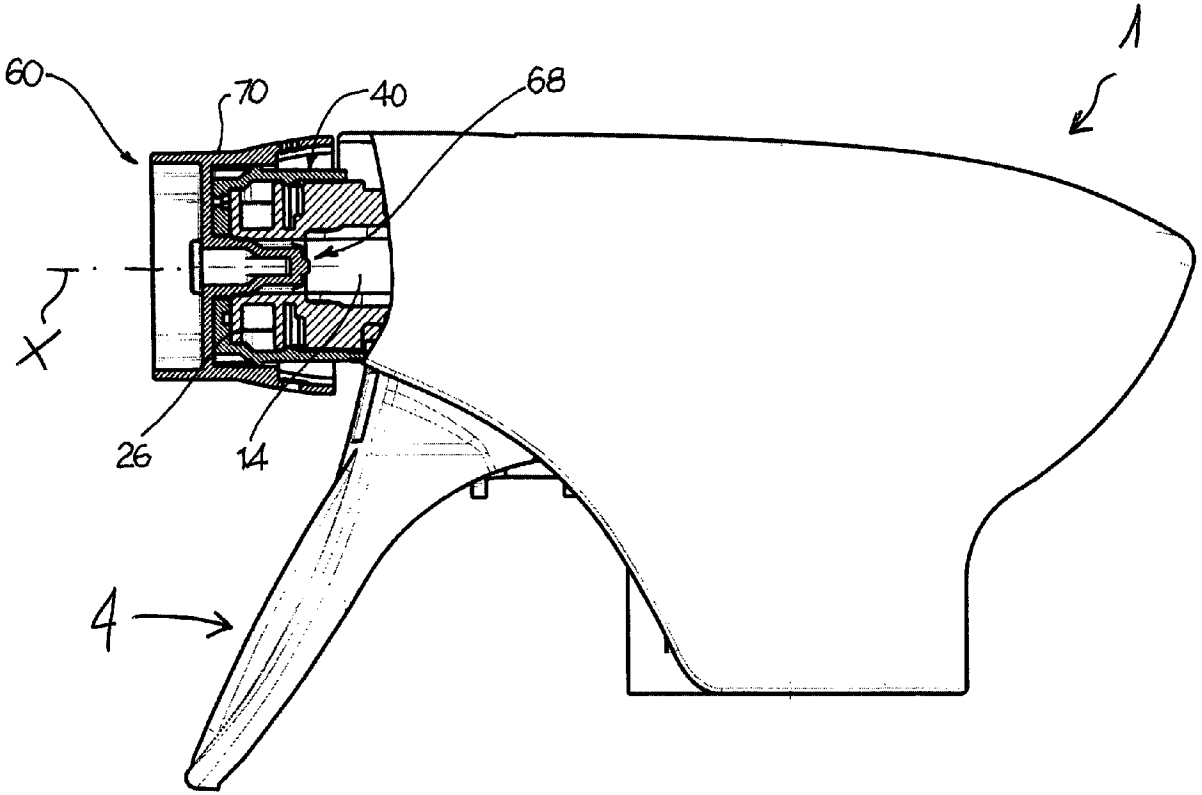
Figure 2A:
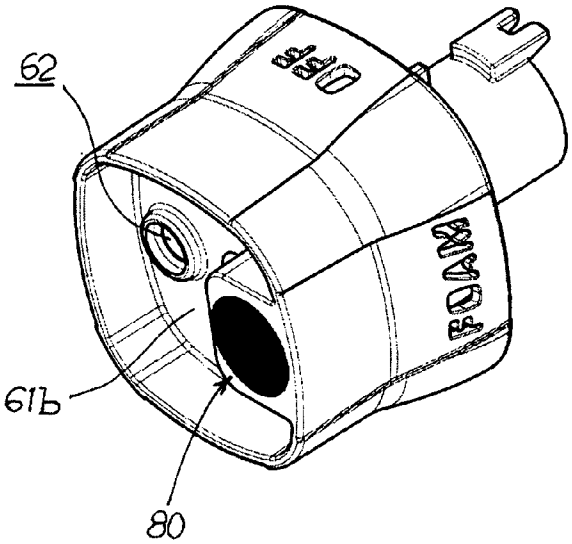
Figure 2B:
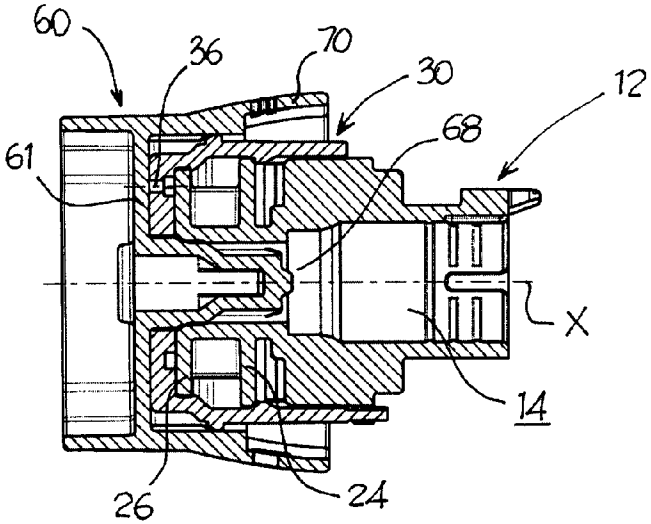
Figure 2C:
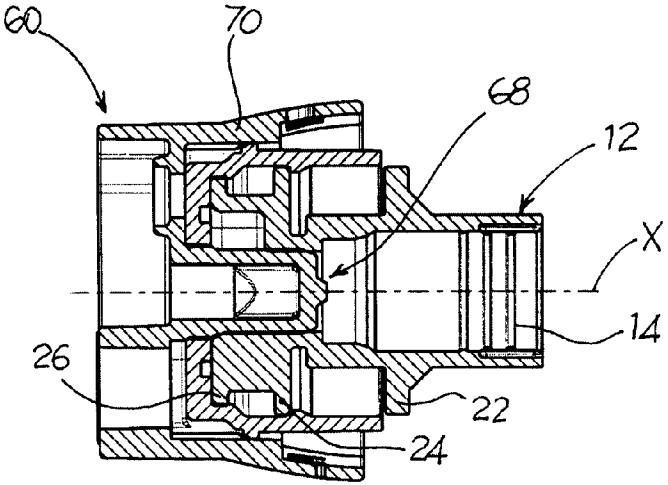
Figure 3A:
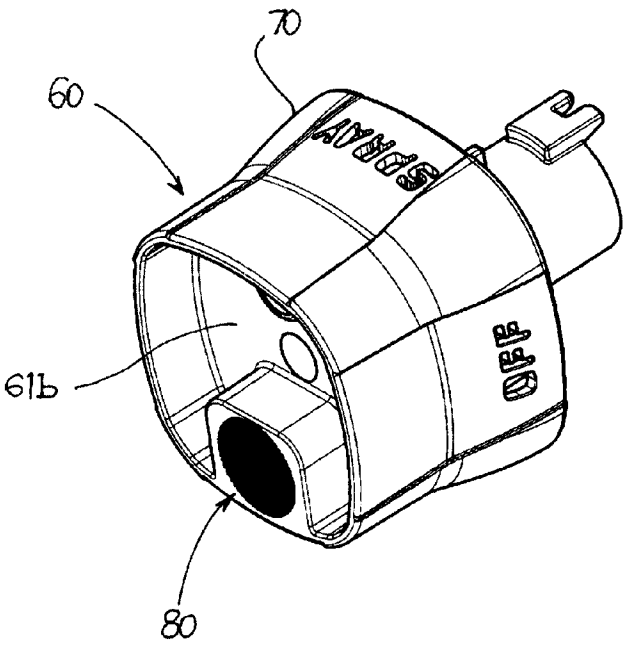
Figure 3B:
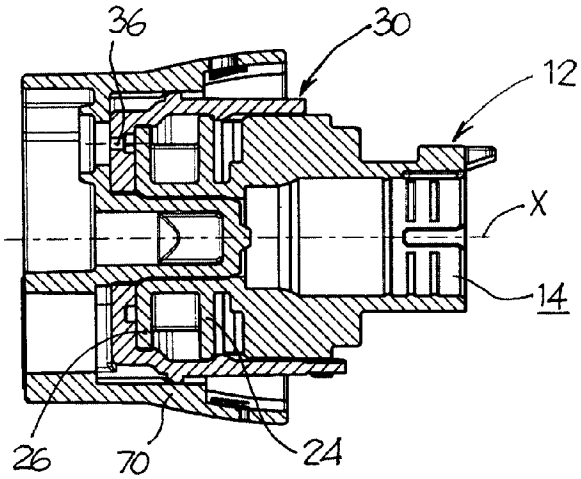
Figure 3C:
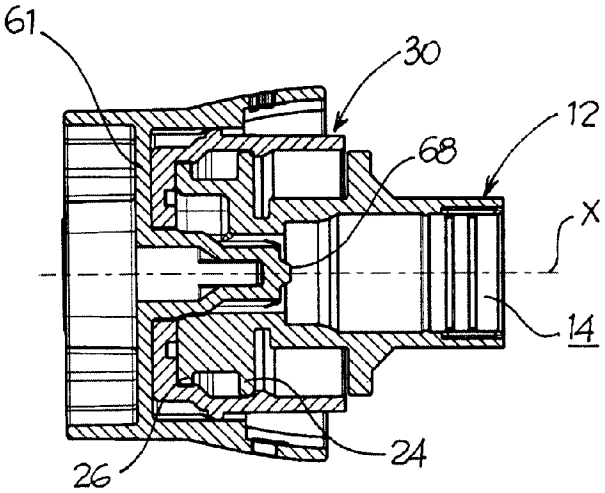
Figure 4A:
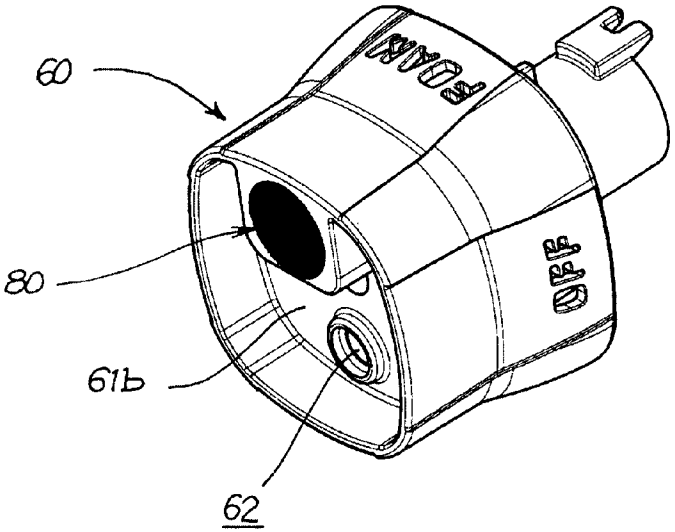
Figure 4B:
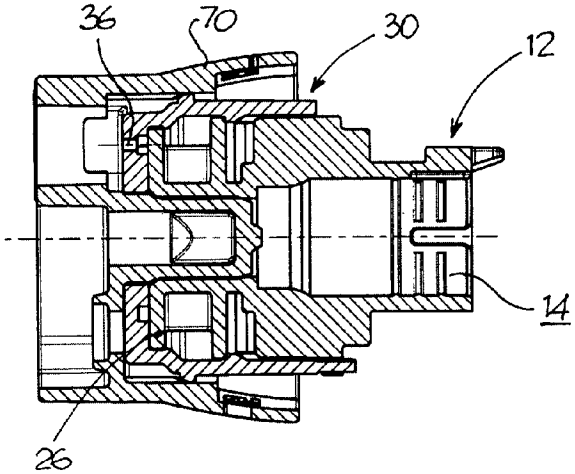
Figure 4C:
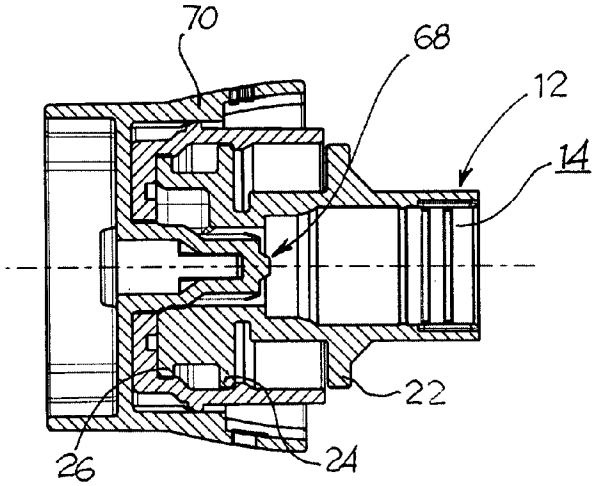
Figure 5:
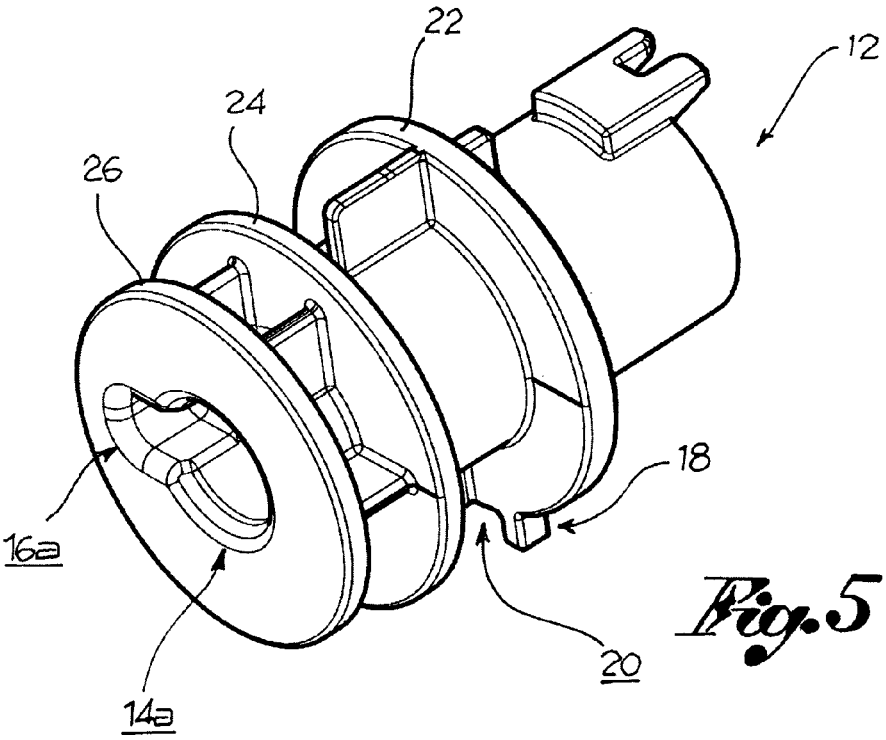
Figure 8:
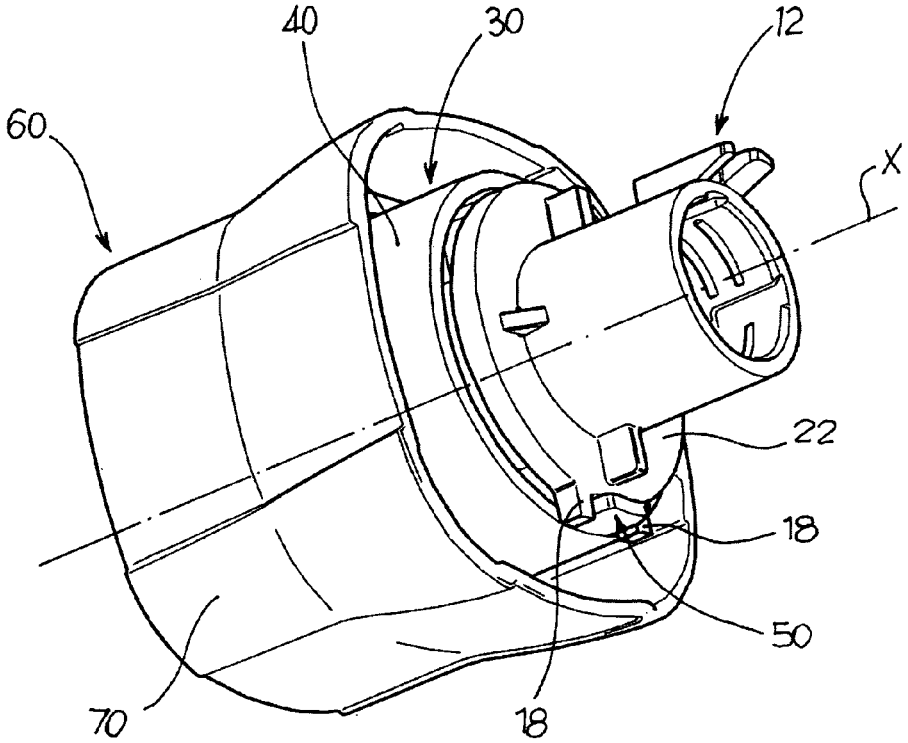
Figure 6A:
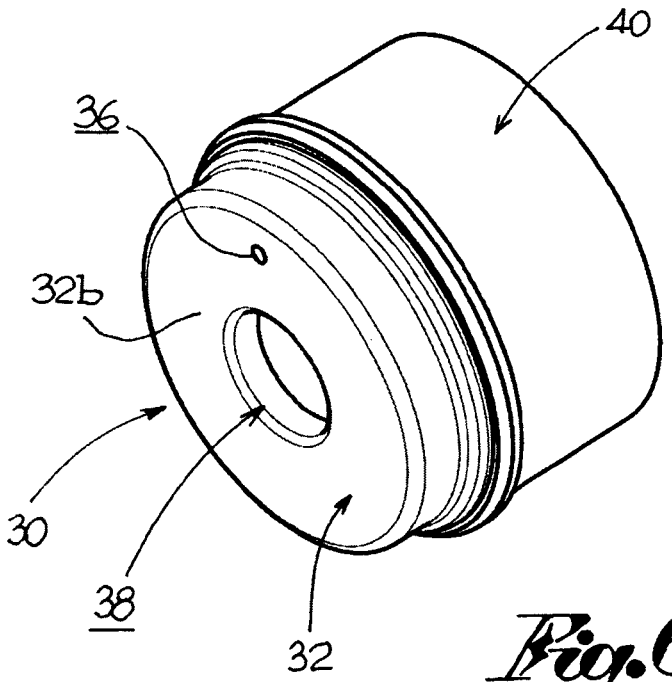
Figure 6B:
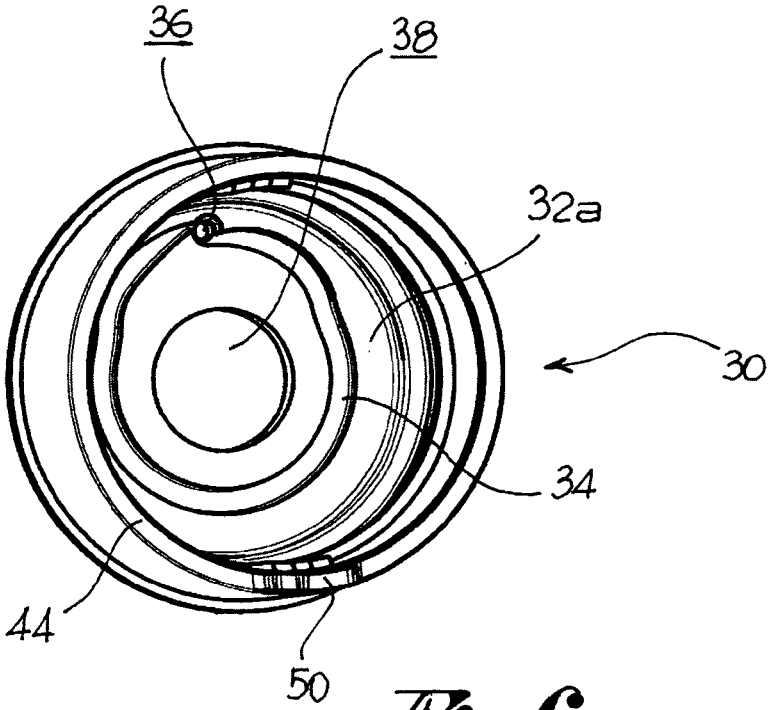
Figure 7A:
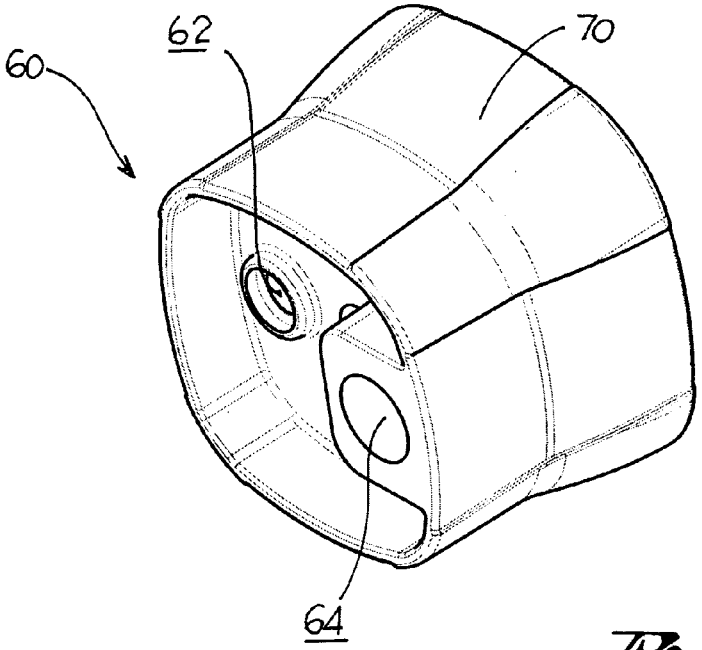
Figure 7B:
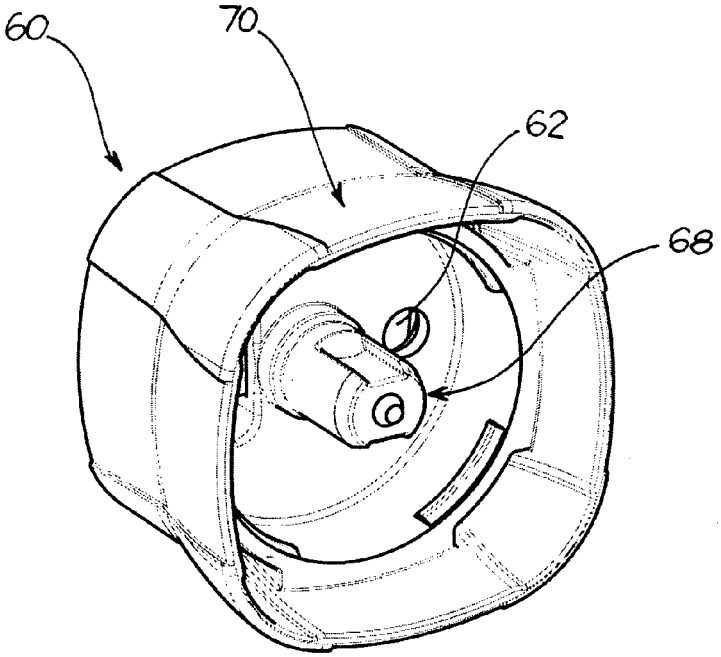

The characteristics and advantages of the dispensing device according to the present invention will be clear from the description below, made by way of a non-limiting example, according to the attached drawings, wherein:

FIG. 1 shows a dispensing head according to one embodiment of the present invention;

FIGS. 2*a*, 2*b* and 2*c* respectively show an axonometric view, a view in longitudinal cross-section and a cross-section, ground view of an assembly formed of a tang, a nozzle and an insert of the dispensing device of FIG. 1, in a closed configuration;

FIGS. 3*a*, 3*b* and 3*c* respectively show an axonometric view, a view in longitudinal cross-section and a cross-section, ground view of an assembly formed of a tang, a nozzle and an insert of the dispensing device of FIG. 1, in a first, open configuration for example for spray dispensing of the liquid;

FIGS. 4*a*, 4*b* and 4*c* respectively show an axonometric view, a view in longitudinal cross-section and a cross-section, ground view of an assembly formed of a tang, a nozzle and an insert of the dispensing device of FIG. 1, in a second, open configuration for example for foam dispensing of the liquid;

FIG. 5 shows an axonometric view of the tang;

FIGS. 6*a* and 6*b* show respective axonometric views from the outside and the inside of the nozzle;

FIGS. 7*a* and 7*b* show respective axonometric views from the outside and the inside of the insert;

FIG. 8 shows an axonometric view of the tang engaged with the nozzle and with the insert.

According to the present invention, a manually operated dispensing device for a liquid, for example trigger-operated, comprises a container to contain the liquid and a dispensing head 1, mechanically associable to the container to dispense the liquid.

In particular, the head 1 is connectable to the neck of the container, for example by means of a threaded connection or a bayonet connection.

The head 1 comprises pumping means suitable for aspirating liquid from the container and sending it towards the outside environment for dispensing.

For example, the pumping means comprise a pumping chamber suitable for placing in fluidic communication with the chamber of the container, an exit duct suitable for being placed in communication with the pumping chamber and with the outside environment, and a piston sealed so as to slide in the pumping chamber.

Furthermore, the head 1 comprises manual operating means suitable for being operated manually to activate the pumping means.

For example, the operating means comprise a trigger connected mechanically to the piston of the pumping means.

The exit duct extends along a straight dispensing axis X.

The head 1 comprises a tubular tang 12 which has an inner tang duct 14, defining a section of the exit duct, and comprises an eccentric section 16 in relation to the dispensing axis X.

In particular, the eccentric section 16 is made as a notch projecting radially in relation to the dispensing axis X, at the distal end of the tang 12.

The tang 12 comprises a pair of outer bosses 18, projecting radially, angularly distanced, between which a housing 20 is formed.

Preferably, the tang 12 comprises a first collar 22, projecting externally radially, from the periphery of which said bosses 18 project.

Preferably, in addition, the tang 12 comprises a second collar 24, projecting externally radially, positioned between the first collar 22 and the end of the tang 12.

According to a preferred embodiment, in addition, the tang 12 comprises a third collar 26, projecting outwards radially, positioned at the end of the tang 12, inside which the duct aperture 14*a* corresponding to the tang duct 14 and the eccentric aperture 16*a*, corresponding to the eccentric section 16 of the tang duct 14 open.

Furthermore, the head 2 comprises a nozzle 30, applicable to the end of the tang 12, comprising a front wall 32, defined internally by an inner face 32*a* and externally by an outer face 32*b*, substantially perpendicular to the dispensing axis X.

The front wall 32 of the nozzle 30 abuts with the tang 12, sealing this, that is abutting with the third collar 26.

The front wall 32 has, in addition, at least one channel 34, made on the inner face 32*a* of the front wall 32, and a through hole 36 through the thickness of the front wall 32, open therefore on the inner wall 32*a* and the outer wall 32*b*, in communication with the channel 34.

The channel 4 extends annularly around the dispensing axis X, forming a closed circuit which starts from the through hole 36 and ends in said through hole 36, surrounding the dispensing axis X.

Once the nozzle 30 has been applied to the tang 12, the channel 34 is in communication with the eccentric section 16 of the tang duct 14.

In addition, preferably, the nozzle 30 has a central aperture 38 in line with the dispensing axis X, of such size and form as to leave completely uncovered the aperture 14*a* of the tang duct 14 and cover at least in part the aperture 16*a* of the eccentric section 16.

In addition, the nozzle 30 comprises an annular skirt 40 projecting axially from the front wall 32, destined to axially overlap the tang 12 at least in part.

Preferably, the skirt 40 comprises at least one inner boss 42, for example annular and continuous, projecting radially internally, able to snap onto the second collar 24 of the tang 12, to hook the nozzle 30 to the tang 12.

Axially, the skirt 40 terminates in an annular rim 44.

In addition, the nozzle 30 comprises a tooth 50, preferably projecting from the skirt 40, for example projecting axially beyond the annular rim 44, suitable for being lodged in the housing 20 of the tang 12, between the bosses 18.

The bosses 18 and the tooth 50 form an example of anti-rotation constraint means able to bilaterally constrain the rotation of the nozzle 30 in relation to the tang 12.

Furthermore, the dispensing head 1 comprises an insert 60, applied to the nozzle 30, fitted with connection means able to connect the insert 60 to the nozzle 30 in a rotatable manner around the dispensing axis X, constraining it axially.

The insert 60 comprises a main wall 61 defined by an inner face 61*a* and an outer face 61*b*, substantially perpendicular to the dispensing axis X.

The insert comprises, in addition, a first opening 62 and a second opening 64, made as through apertures crossing the axial thickness of the main wall 61 having their entrances on the inner surface 61*a*, positioned angularly distanced in relation to the dispensing axis X, for example by 180°.

For example, the insert 60 comprises a mesh 80, applied to the second opening 64 to dispense the liquid as a foam.

Preferably, in addition, the insert 60 comprises an obturator 68 made by an axial protuberance, coaxial to the dispensing axis X, projecting from the main wall 61, extending so as to cross the front wall 32 of the nozzle 30 and insert itself in the nozzle duct 14 of the tang 12 through the aperture 14*a*.

The obturator 68 is suitable, rotating around the dispensing axis X, to close/open access between the tang duct 14 and the eccentric section 16.

To such purpose, the obturator is annularly shaped, at least in an end section, with two circular, partially cylindrical surfaces, opposite the dispensing axis, and two flat and parallel surfaces, also opposite the dispensing axis.

Preferably, in addition, the insert 60 comprises an annular mantle 70, projecting axially from the main wall 61, destined to axially overlap the skirt 40 of the nozzle 30 at least partially.

The mantle 70 is suitable for being rotated manually, to rotate the insert 60.

Preferably, the mantle 70 has on its outer surface explanatory indications of the functioning configuration of the dispensing head. For example, the mantle has on the outer surface indentations forming the word "OFF" or symbols or captions, such as "SPRAY" or "FOAM", which identify the type of jet obtained when said symbol is aligned with a fixed indicator in relation to rotation of the insert.

By rotating the insert 60 around the dispensing axis X, the first opening 62 and the second opening 64 are selectively in communication with the through hole 36 of the nozzle 30, so as to select the desired type of jet.

In a closed configuration, corresponding to an angular, closed position of the insert 60 (FIGS. 2*a* to 2*c*), the obturator 68 of the insert 60 closes the fluidic connection between the nozzle duct 14 and the eccentric section 16. No dispensing of liquid is therefore performed.

In a first dispensing configuration, corresponding to a first angular dispensing position of the insert 60 (FIGS. 3*a* to 3*c*), rotated in relation to the closed angular position, the obturator 68 leaves the passage from the nozzle duct 14 to the eccentric section 16 free and the first opening 62 is at least partially overlapped at the through hole 36 of the nozzle 30.

During manual rotation of the insert 60, the nozzle remains fixed, in as much as constrained by the anti-rotation constraint means to the tang 12.

Two conditions arise: the liquid transits from the nozzle duct 14 to the eccentric section 16 and from this, following the channel 34 of the nozzle, reaches the through hole 36; the at least partial alignment of the first opening 62 and the through hole 36 makes it possible to dispense the liquid, for example in the form of a spray.

In said first dispensing configuration, the second opening 64 is not in fluidic communication with the through hole 36; consequently, no liquid is dispensed from the second opening 64.

By rotating the insert 60 from the position of the first configuration, for example by 180°, one reaches a second dispensing configuration (FIGS. 4*a* to 4*c*), wherein the obturator 68 leaves the passage from the nozzle duct 14 to the eccentric section 16 free and the second opening 64 is at least partially overlapped at the through hole 36 of the nozzle 30.

During manual rotation of the insert 60, the nozzle remains fixed, in as much as constrained by the anti-rotation constraint means to the tang 12.

Two conditions arise: the liquid transits from the nozzle duct 14 to the eccentric section 16 and from this, following the channel 34 of the nozzle, reaches the through hole 36; the at least partial alignment of the second opening 64 and the through hole 36 makes it possible to dispense the liquid, for example in the form of foam.

In said first dispensing configuration, the first opening 62 is not in fluidic communication with the through hole 36; consequently, no liquid is dispensed from the first opening 62.

Innovatively, the dispensing head according to the present invention is extremely simple to use, especially as regards the selection of a specific form of jet and closing of the device.

Such simplicity of use is combined with a considerable structural simplicity, which makes production cheaper.

According to a further advantageous aspect, the dispensing device can be used in an intuitive manner in that the jet of liquid dispensed is always in the same position in relation to the dispensing device, thereby not confusing the user. For example, in the embodiment shown, looking at the insert of FIG. 3*a* or 4*a* from the front, dispensing is always from the top window, while by rotating the nozzle the type of jet dispensed is changed.

The invention claimed is:

1. Dispensing head (1) for a liquid comprising:

a) pumping means suitable for being activated manually to aspirate the liquid from a container and dispense it to the outside, comprising an exit duct extending along a dispensing axis (X);

b) a nozzle (30) applied to an end section of the exit duct, comprising a front wall (32) having a through hole (36) eccentric to the dispensing axis (X), suitable for being placed in fluidic communication with the duct (6);

c) an insert (60) applied to the nozzle (30) bound axially and rotatable around the dispensing axis (X), fitted with at least two openings (62, 64) distanced angularly, suitable for being selectively placed in communication with the through hole (36) of the nozzle (30) by rotation of the insert;

wherein the insert (60) comprises an obturator (68) which is a protuberance projecting axially to cross the front wall (32) of the nozzle (30), said obturator being shaped so as to close fluidic communication between the exit duct and the through hole (36) by rotation of the insert.

2. Head according to claim 1, wherein the obturator is shaped so that when fluidic communication between the exit duct and the through hole (36) is open, one of said apertures (62, 64) is in fluidic communication with said through hole (36).

3. Head according to claim 2, wherein the obturator (68) is shaped externally by two partial circular surfaces facing each other in relation to the dispensing axis (X), and two flat and parallel surfaces facing each other in relation to the dispensing axis (X).

4. Head according to claim 1, comprising a mesh (80) applied to one of said openings (62, 64).

5. Head according to claim 1, comprising bidirectional, anti-rotation constraint means suitable to prevent relative rotation between the nozzle and the exit duct.

6. Head according to claim 1, comprising, in addition:

d) a tubular tang (12), extending along the dispensing axis (X), applied to the end section of the exit duct, to which said insert is applied (60).

7. Head according to claim 6, wherein the tang (12) has a tang duct (14) comprising an eccentric section (16) in relation to the dispensing axis, with which said through hole (16) of the nozzle (30) is in fluidic communication.

8. Head according to claim 6, wherein said obturator is shaped to allow/obstruct access to said eccentric section (16) by rotation of the insert.

9. Head according to claim 6, comprising bidirectional, anti-rotation restraints between the tang (12) and the nozzle (60), suitable to prevent relative rotation between them.

10. Head according to claim 9, wherein said means of restraint comprise a pair of bosses (18) projecting radially externally from the tang (12) and between which a housing is created (20), and a tooth (50) projecting axially from the nozzle (30), lodged in said housing (20).

11. Head according to claim 1, wherein the nozzle (60) has, on an inner face (32*a*) of the front wall (32) a channel (34) to place the exit duct (2) in fluidic communication with the through hole (36).

12. Head according to claim 11, wherein the channel (34) has a path annularly closed around the dispensing axis (X), starting from the through hole (36) and ending in said through hole (36).

13. Head according to claim 2, comprising a mesh (80) applied to one of said openings (62, 64).

14. Head according to claim 13, comprising bidirectional, anti-rotation constraint means suitable to prevent relative rotation between the nozzle and the exit duct.

15. Head according to claim 14, comprising, in addition:

d) a tubular tang (12), extending along the dispensing axis (X), applied to the end portion of the exit duct, to which said insert is applied (60).

16. Head according to claim 15, wherein the nozzle (60) has, on the inner face (32*a*) of the front wall (32) a channel (34) to place the exit duct (2) in fluidic communication with the through hole (36).

* * * * *